US007044075B2

(12) United States Patent
Sica et al.

(10) Patent No.: US 7,044,075 B2
(45) Date of Patent: May 16, 2006

(54) MARINE VESSEL CORROSION CONTROL SYSTEM

(76) Inventors: Joseph D. Sica, 8729.5 E. Bay Dr., Treasure Island, FL (US) 33706; Maurice L. Jackson, 4005 S. Church Ave., Tampa, FL (US) 33611

( * ) Notice: Subject to any disclaimer, the term of this patent is extended or adjusted under 35 U.S.C. 154(b) by 0 days.

(21) Appl. No.: 10/939,426

(22) Filed: Sep. 14, 2004

(65) Prior Publication Data

US 2006/0054072 A1 Mar. 16, 2006

(51) Int. Cl.
*C23F 13/00* (2006.01)
*B63B 59/00* (2006.01)

(52) U.S. Cl. ..... 114/222; 204/196.01

(58) Field of Classification Search ..... 114/222, 114/67 R; 204/196.01, 196.02, 196.03, 196.22, 204/196.25

See application file for complete search history.

(56) References Cited

U.S. PATENT DOCUMENTS

| | | | | |
|---|---|---|---|---|
| 2,402,494 | A | | 6/1946 | Hantzsch et al. |
| 3,004,905 | A | | 10/1961 | Sabins |
| 3,055,813 | A | | 9/1962 | Schaschl et al. |
| 3,098,026 | A | | 7/1963 | Anderson |
| 3,129,154 | A | | 4/1964 | Fry |
| 3,208,925 | A | | 9/1965 | Hutchison et al. |
| 3,362,900 | A | * | 1/1968 | Sabins ..... 204/196.03 |
| 3,841,988 | A | * | 10/1974 | Gleason ..... 204/196.03 |
| 3,953,742 | A | * | 4/1976 | Anderson et al. ..... 204/196.03 |
| 4,136,309 | A | | 1/1979 | Galberth et al. |
| 4,510,030 | A | | 4/1985 | Miyashita et al. |
| 5,026,468 | A | * | 6/1991 | Carpenter et al. ..... 204/196.02 |
| 5,139,634 | A | | 8/1992 | Carpenter et al. |
| 5,627,414 | A | | 5/1997 | Brown et al. |

* cited by examiner

*Primary Examiner*—Sherman Basinger
(74) *Attorney, Agent, or Firm*—Larson & Larson, PA; Herbert W. Larson

(57) ABSTRACT

A marine vessel corrosion control system contemplates redundant protection for a marine vessel against the effects of galvanic corrosion. The vessel is equipped with typical zinc anodes interconnected together and attached to metallic components to be protected from galvanic corrosion. A reference electrode immersed in the water provides signals to a control box representative of electrode voltage as compared to an internal stabilized voltage standard. The control box compares the reference electrode voltage with the internal stabilized voltage standard and feeds current through a hull mounted anode into the water and through the submerged metal parts of the vessel. A relay allows selective interruption of the connection between the passive zincs and the vessel ground and selective closing of that circuit. The relay is connected to the control box and when the control box fails in any way, this failure is sensed and results in deactivation of the normally closed relay to electrically interconnect the passive zincs to the vessel ground until the active galvanic corrosion control system is repaired.

18 Claims, 10 Drawing Sheets

MARINE VESSEL CORROSION CONTROL SYSTEM

BACKGROUND OF THE INVENTION

The present invention relates to a marine vessel corrosion control system. In the prior art, it is well known that metallic parts of a marine vessel submerged underwater are susceptible to corrosion through the process known as electrolysis. Galvanic corrosion is typically a slow process, however, over a lengthy period of time, it can result in deterioration of underwater metallic parts and in endangerment of the watertight integrity of a boat hull. Those of ordinary skill in the art realize that galvanic corrosion promotes deterioration and failure of underwater parts made of alloys of bronze. Left unprotected, such alloys waste away resulting in failure of component parts.

Under circumstances where stray currents arise from current leakage from a vessel as well as from external power sources, galvanic corrosion can be much more rapid and catastrophic.

For many years, boat manufacturers have included in the boats they manufacture numerous pieces of a sacrificial anode material such as pure zinc or an alloy of aluminum fastened to parts that might be subject to galvanic corrosion, with these anodes electrically connected together using heavy gauge conductors connected to the vessel's electrical ground. Such a system facilitates deterioration of the sacrificial anodes rather than of the component parts to which they are attached. Other systems have been devised to control galvanic corrosion including the use of a source of electrical current supplied to anodes attached to the component parts of the vessel that are to be protected. Such systems can be effective but, if they fail, for any reason, the boat owner is left with a completely unprotected vessel in which the submerged metallic component parts are immediately subject to galvanic corrosion.

As such, a need has developed for a system for protecting a marine vessel against the effects of galvanic corrosion that includes a back-up system that is effective when the primary system is rendered inoperative for any reason.

Applicants are aware of the following U.S. patents:

| |
|---|
| 2,402,494 to Hantzsch et al. |
| 3,004,905 to Sabins |
| 3,055,813 to Schaschl et al. |
| 3,098,026 to Anderson |
| 3,129,154 to Fry |
| 3,208,925 to Hutchison et al. |
| 4,136,309 to Galberth |
| 4,510,030 to Miyashita |
| 5,139,634 to Carpenter |
| 5,627,414 to Brown et al. |

Each of the above-listed references teaches a system for protecting a vessel or structure against the effects of galvanic corrosion. Carpenter teaches such a device including selective use of an impressed or sacrificial protection anode assembly for a well. None of the other patents teaches breaking a connection of a sacrificial zinc anode using an energized magnetic coil or digital switch. The present invention differs from the teachings of these patents alone or in combination as contemplating a passive system for protecting the metallic component parts of a marine vessel from the effects of galvanic corrosion in combination with an active galvanic corrosion prevention system that impresses a desired electrical current on the submerged metallic component parts. The system of the present invention differs from the teachings of these patents as including a switching system that senses when the active system is inoperative and switches the passive zincs into connection with the submerged metallic components to maintain protection until such time as the active system may be repaired and placed back into operation.

SUMMARY OF THE INVENTION

The present invention relates to a marine vessel corrosion control system. The present invention includes the following interrelated objects, aspects and features:

(1) The present invention contemplates redundant protection for a marine vessel against the effects of galvanic corrosion. In a first aspect, the vessel is equipped with typical zinc anodes that consist of a passive sacrificial protection system for the submerged metallic component parts thereof. The "zincs" are interconnected together using heavy electrical conductor and each of them is attached to a particular metallic component that is to be protected from galvanic corrosion. The electrical conductor is connected to the vessel's ground.

(2) In an important aspect, the connection between the zincs and the vessel ground, consisting of an electrical conductor, includes a switch interposed into the electrical conductor that allows the passive zinc system to be selectively activated and de-activated in a manner that will be better explained hereinafter.

(3) The inventive system also contemplates controller means comprising a microcontroller including a control box and a reference electrode immersed in the water in which the vessel floats that provides signals to the control box representative of electrode voltage as compared to an internal stabilized voltage standard. The control box is powered by a source of electrical current comprising a 12 volt DC battery and compares the reference electrode voltage with the internal stabilized voltage standard and, responsive thereto, feeds current through a hull mounted anode into the water and thereafter through the submerged metal parts of the vessel until, through measurement, it is determined that a desired voltage difference between the reference electrode and the internal voltage standard has been met. This desired voltage difference is maintained throughout the operation of the inventive device.

(4) If desired, the inventive device may also include a display including indicator lights indicating proper operation of the present invention as will be explained in greater detail hereinafter.

(5) The circuitry associated with the control box includes switch means comprising a relay that allows selective interruption of the connection between the passive zincs and the vessel ground and selective closing of that circuit. The relay is connected to the control box. When the control box is operating normally, a signal is sent to the relay to hold it open. When the control box fails in any way, this failure is sensed and results in deactivation of the signal and thereby of the normally closed relay to thereby electrically interconnect the passive zincs to the vessel ground via the electrical conductor, described above, so that the passive zinc galvanic corrosion protection system is operating until such time as the active galvanic corrosion control system may be repaired and placed back into service. Cessation of the signal comprises malfunction sensing means.

As such, it is a first object of the present invention to provide a marine vessel corrosion control system.

It is a further object of the present invention to provide such a system in which a passive zinc corrosion protection system is provided as a back-up to an active galvanic corrosion protection system.

It is a further object of the present invention to provide such a device in which a voltage from a reference electrode is compared with an internal voltage standard to determine the power supplied through the active system to the submerged metallic components of a marine vessel.

It is a still further object of the present invention to provide a relay connected to a control box wherein the relay closes to activate the passive zinc galvanic corrosion protection system when a fault is detected in the active system.

It is a yet further object of the present invention to provide such a system in which a display is provided that displays indicia indicating the status of operation of the inventive system.

These and other objects, aspects and features of the present invention will be better understood from the following detailed description of the preferred embodiment when read in conjunction with the appended drawing figures.

BRIEF DESCRIPTION OF THE DRAWINGS

FIGS. 1–8 are related to one another to create the inventive circuit.

SPECIFIC DESCRIPTION OF THE PREFERRED EMBODIMENT

Figure 10:
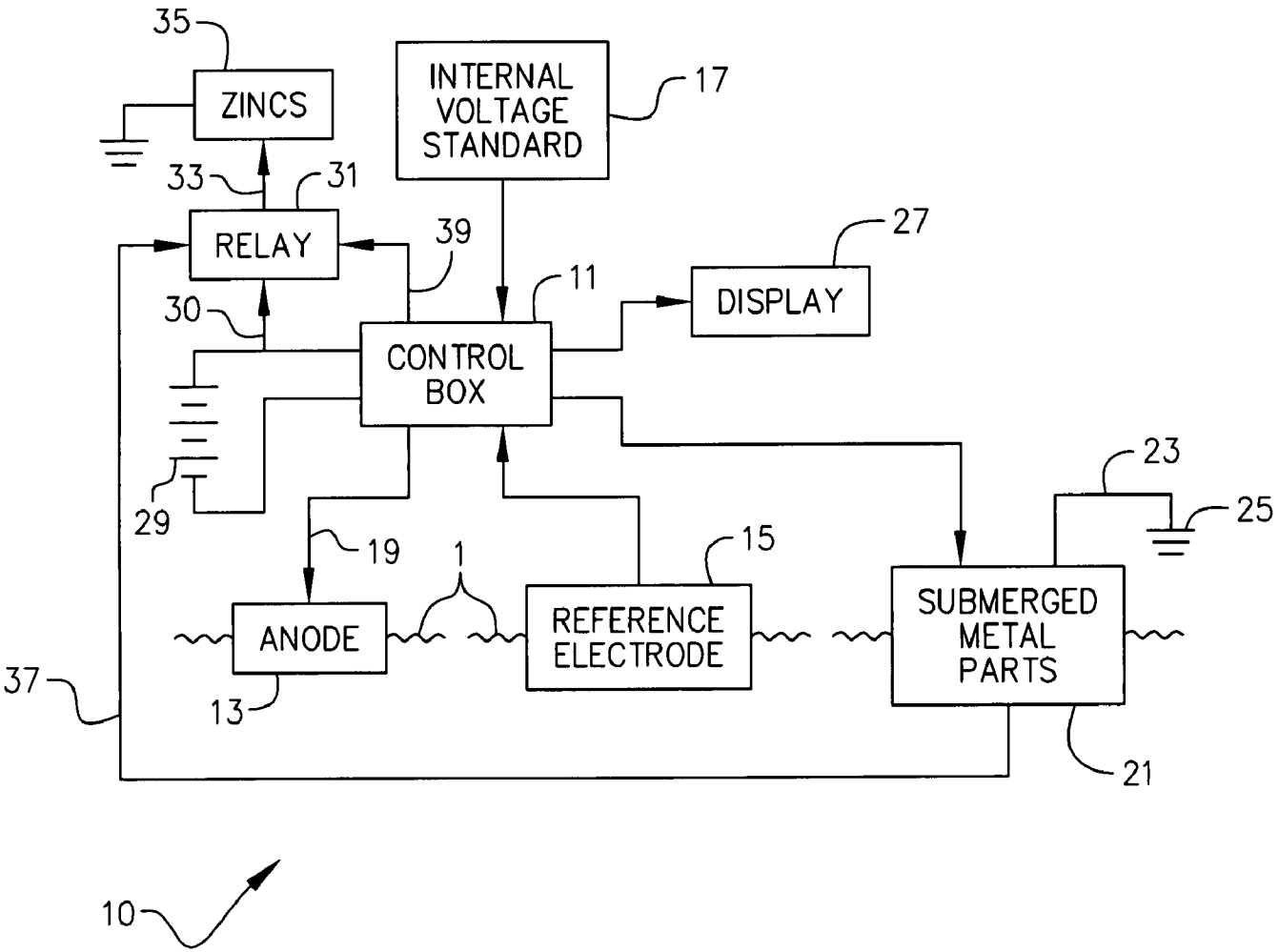
FIG. 10 shows a schematic representation of the various components of the present invention to best facilitate explanation as to its operation.

Reference is first made to FIG. 10 so that an overview of the components and operation of the present invention will be understood. In FIG. 10, the present invention is generally designated by the reference numeral 10 and is seen to include a control box 11 that controllably supplies electrical current to an anode 13 submerged within a body of water schematically designated by the reference numeral 1. A reference electrode 15 is also submerged within the body of water 1 and the control box 11 samples the water potential through the use of the electrode 15 which may, if desired, comprise a silver-silver chloride reference electrode. By closed loop feedback, the control box 11 compares the reference electrode voltage with an internal stabilized voltage standard shown as reference numeral 17 in FIG. 10. Responsive to comparing the voltage standard 17 with the reference electrode 15 voltage, the control box 11 supplies current through the anode 13 via the conductor 19, which conveys the current into the body of water 1 and thence through the submerged metal parts schematically identified by the reference numeral 21 in FIG. 10, which are also connected to ground 25 via electrical conductor 23.

A display 27 displays the operative status of the system 10. A source of electrical current comprising battery 29 provides a source of power for the control box 11 and also provides power to the normally closed relay 31 via conductor 30. The relay 31 includes a coil-operated switch 33 that interrupts electrical connection between the zincs 35 and the submerged metal parts 21 via the electrical conductor 37 when the system 10 is operating properly. The relay 31 is connected to the control box 11 via conductor 39.

In the operation of the system illustrated in FIG. 10, as explained above, the control box 11 senses reference electrode voltage and compares it to the internal voltage standard 17 and, responsive to that comparison, supplies an appropriate level of current through the conductor 19 to the anode 13 which transmits current through the body of water 1 to the submerged metal parts 21 that are also connected to the ground 25 via the conductor 23.

Any malfunction of the control box 11 such as, for example, loss of power from the battery 29, causes the relay 31 to close in a manner well known to those of ordinary skill in the art, thereby causing the switch 33 to close connecting the passive galvanic corrosion protection system, consisting of one or more zincs 35, to the submerged metal parts 21 via the electrical conductor 37. This interconnection between one or more zincs 35 and the submerged metal parts 21 is schematically shown in FIG. 10 in a manner promoting appropriate understanding thereof. In fact, the individual zincs, if more than one is used, may be fastened to the various metallic components of the vessel that are submerged when the vessel is in the body of water 1. The relay is located in such a way that it can selectively interrupt or connect the electrical continuity between the zincs and the vessel ground 25 via the interconnecting electrical conductors that are provided between the various zincs and the ground. In FIG. 10, the relay 31 is shown interposed between the zincs 35 and submerged metal parts 21. If desired, instead, the relay 31 could be interposed between the submerged metal parts 21 and the ground 25. As should be understood, one zinc provides sufficient protection until the system malfunction is corrected and that single zinc may, in fact, be isolated from the submerged metallic components.

Reference is now made to FIGS. 1–9 so that an understanding of the electrical circuitry of the present invention may be had. In order to best understand the electrical circuitry of the present invention, when each of FIGS. 1-8 is being explained, it is best to refer to the particular Figure being discussed along with FIG. 9 so that an understanding of the context of the Figure in the entire circuit may be best understood.

Figure 1:
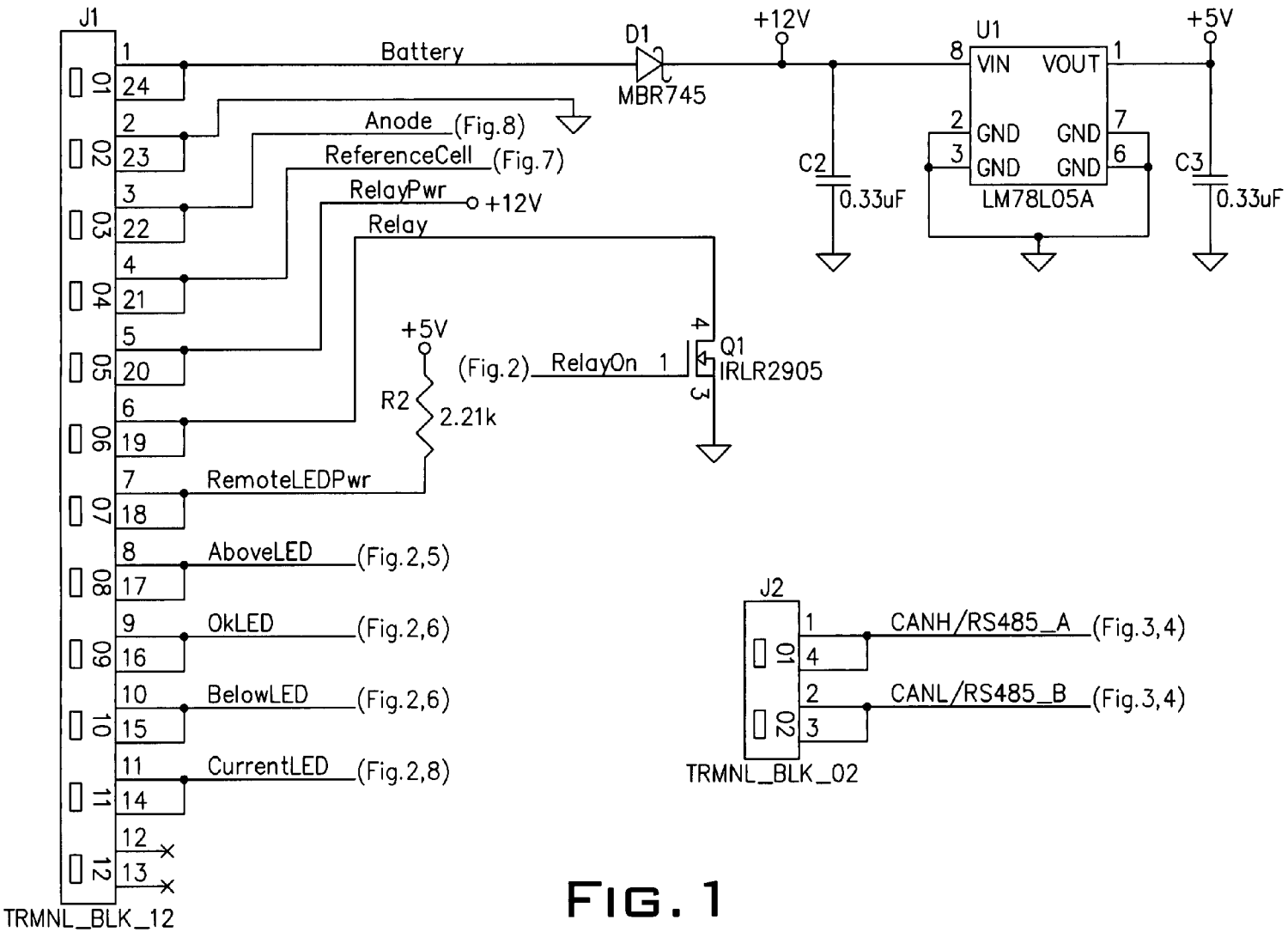
FIGS. 1–8 show respective portions of the electrical circuitry of the present invention.

With reference first to FIG. 1 (in conjunction with FIGS. 9 and 10), J1 and J2 consist of terminal blocks that allow connection to and from the corrosion control circuit board contained within the control box 11. On the terminal block J1, pins 1/24 and 2/23 provide power to the inventive circuit from the battery 29 (FIG. 10). In the preferred embodiment, the battery 29 consists of one or more 12 volt DC batteries that supply a voltage to the system. Each battery provides voltage in the range of 10.5 to 14.4 volts relative to the ground terminal of the battery that is wired to the ground reference on the circuit board via the pin 2/23 on the terminal block J1. Where two batteries are provided, for example, in series, the voltage is up to 28 volts.

With further reference to FIG. 1, the components D1, C2, U1 and C3 combine together to make up a voltage regulator that converts voltage from the battery 29 to +5 volts DC which is used to power certain necessary sub-circuits on the circuit board. The anode connection on terminal block J1 at pin 3/22 goes to a conductor assembly that is mounted elsewhere on the marine vessel and in contact with the water so as to provide an offsetting voltage and current that maintains a prescribed electromagnetic potential that inhibits the process of corrosion. This corresponds to reference numerals 19 and 13 in FIG. 10. The reference cell connection on the terminal block J1 at pin 4/21 connects to the reference electrode probe 15 (FIG. 10) that provides a potential voltage when in contact with the water and establishes a reference feedback voltage to allow the control box 11 to provide the anode 13 with the correct voltage and current.

The relay power connection on the terminal block J1 at pin 5/20 is a power connection (+12 volts DC) to one side of a coil on the relay 31 (FIG. 10) that, when activated, closes an electrical connection (reference numeral 33 in FIG. 10) between a sacrificial anode 35 and the grounding system of the marine vessel in the event the inventive control circuit board fails.

The relay connection on the terminal block J1, pin 5/19, connects to the opposite side of the above-described coil in the relay 31 and is used to activate the relay 31 to open the connection between the zincs 35 and the grounding system of the vessel to allow the inventive circuit board to operate as intended. Again, upon any failure of the control box 11 including the corrosion control circuitry contained therein, the relay 31 is closed and allows the back-up passive sacrificial anode system to be engaged.

The component Q1 is an N Channel MOSFET that receives a logic level from the corrosion control circuit microcontroller 11 to open or close the relay 31 and acts as a switch to provide or interrupt current flow to the relay coil.

Figure 9:
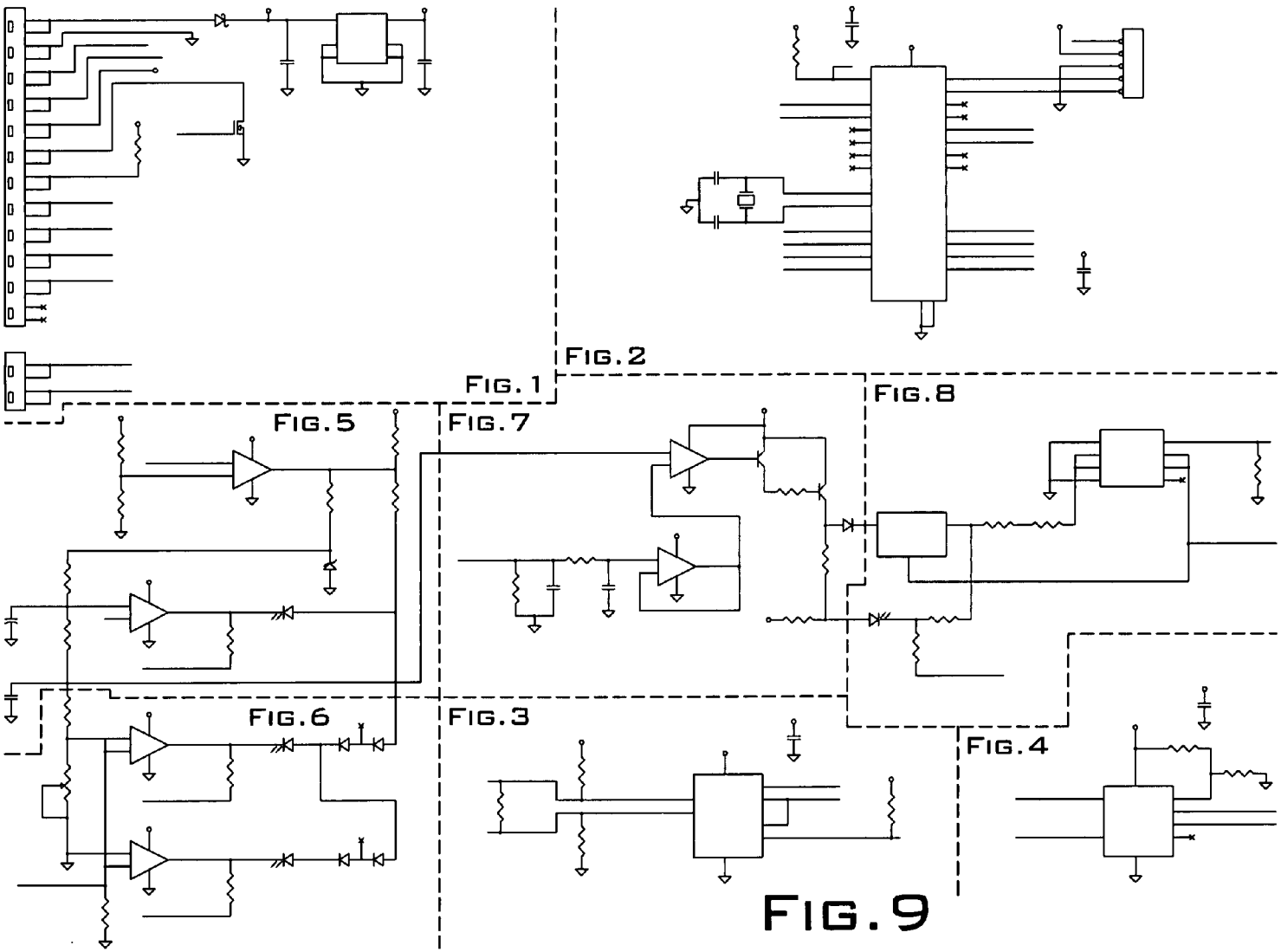
FIG. 9 provides a key that explains how

With continuing reference to FIGS. 1, 9 and 10, the RemoteLEDPwr connection on terminal block J1 at pin 7/18 is a connection to the anodes of a set of remote LEDs and provides power through the current limiting resistor R2 for activation of the LEDs. The connection "AboveLED" on the terminal block J1 at pin 8/17 is a logic level control coming from the corrosion control circuit microcontroller 11 and is used to activate a corresponding LED that indicates on the display 27 an operating condition of the anode voltage being above the normal operating voltage point relative to the reference voltage thereof. The connection OkLED on terminal block J1 at pin 9/16 is a logic level control coming from the corrosion control circuit microcontroller 11 and is used to activate a corresponding LED on the display 27 that indicates an operating condition of the anode voltage being at the normal and nominal operating voltage point relative to the reference voltage coming from the reference electrode 15.

The connection BelowLED on terminal block J1 at pin 10/15 is a logic level control coming from the corrosion control circuit microcontroller and is used to activate a corresponding LED on the display 27 that indicates an operating condition of the anode voltage being below the normal operating voltage point relative to the reference voltage from the reference electrode 15. The connection "CurrentLED" on terminal block J1 at pin 11/14 is a logic level control coming from the corrosion control circuit microcontroller 11 and is used to activate a corresponding LED on the display 27 that indicates an operating condition of the anode current being above a prescribed operating current.

The connector J2 is a two terminal connection that is used to connect the corrosion control microcontroller to a digital communication channel and allows the corrosion control system 10 to communicate with peripheral devices using either a RS485 or CAN communication protocol. In FIG. 1, reference is made to other Figures, namely, FIGS. 2, 4, 7 and 8, to best facilitate understanding of interconnections between various sub-components of the circuitry depicted in FIGS. 1–8.

Figure 2:
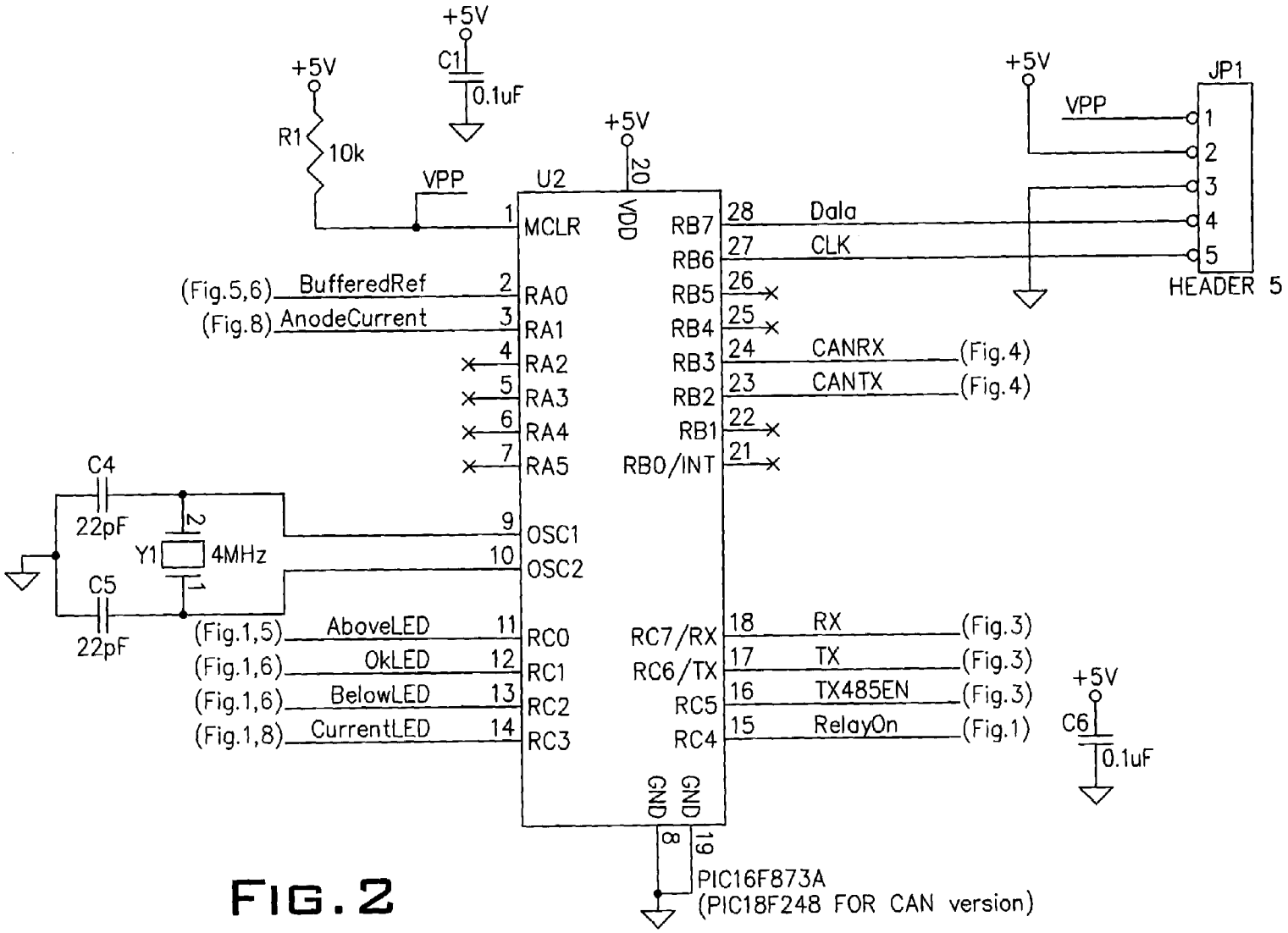

With reference, now, to FIG. 2, U2 comprises a microcontroller that communicates with peripheral devices through RS485 or CAN channels controlling the fail-safe sacrificial anode relay 31 and activating the remote LED display 27. U2 may also be used to implement the equivalent of the analog threshold functions of other parts of the circuit including balancing of the feedback loop associated with balancing the voltage and current provided to the anode assembly by virtue of comparison of the voltages from the reference electrode 15 and the internal voltage standard 17, and alternatively, provide the drive signal to the anode voltage/current generating circuitry included in the control box 11.

The port JP1 allows in-situ programming of the microcontroller U2 in a manner well understood by those of ordinary skill in the art. Filter capacitors C1 and C6 are provided, and R1 is a master clear pull up resistor. Y1, C4 and C5 combine together to comprise a crystal oscillator circuit that provides a master clock to the microcontroller. As explained above with reference to FIG. 1, FIGS. 1, 3, 4, 5 and 8 are identified in FIG. 2 so that the reader will know where the connections are between various conductors included in the inventive circuitry.

Figure 3:
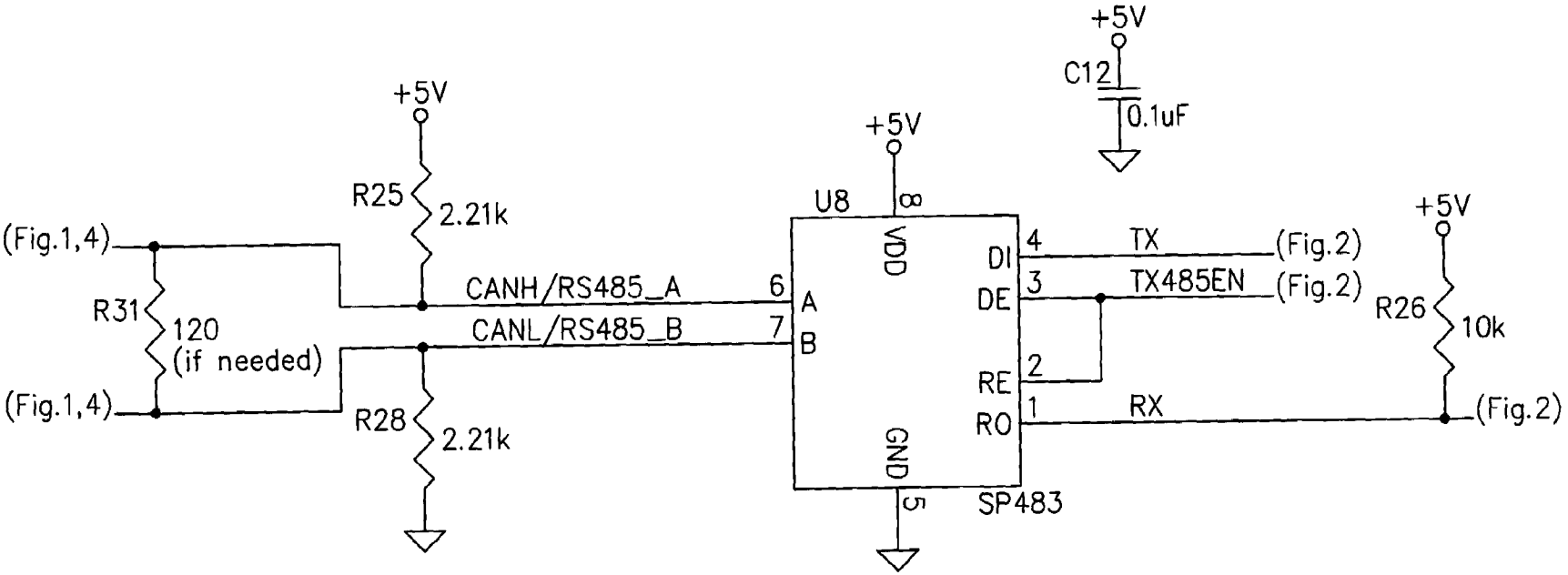

In FIG. 3, U8 is a device that converts signals between a Universal Synchronous Asynchronous Receiver Transmitter (USART) transmitter and receiver pair on the microcontroller U2 and a RS485 communication channel. R25 and R28 are pull-up and pull-down resistors, respectively, for the differential RS485 signal pair. R31 is an optional termination resistor while C12 is a filter capacitor. R26 is a pull-up resistor to allow a correct state on the receiver output from U8 when in the transmitter mode. FIGS. 1 and 2 are also identified in FIG. 3 to show the interconnection of the sub-circuitry of FIG. 3 into the entire circuit as shown in FIG. 9.

Figure 4:
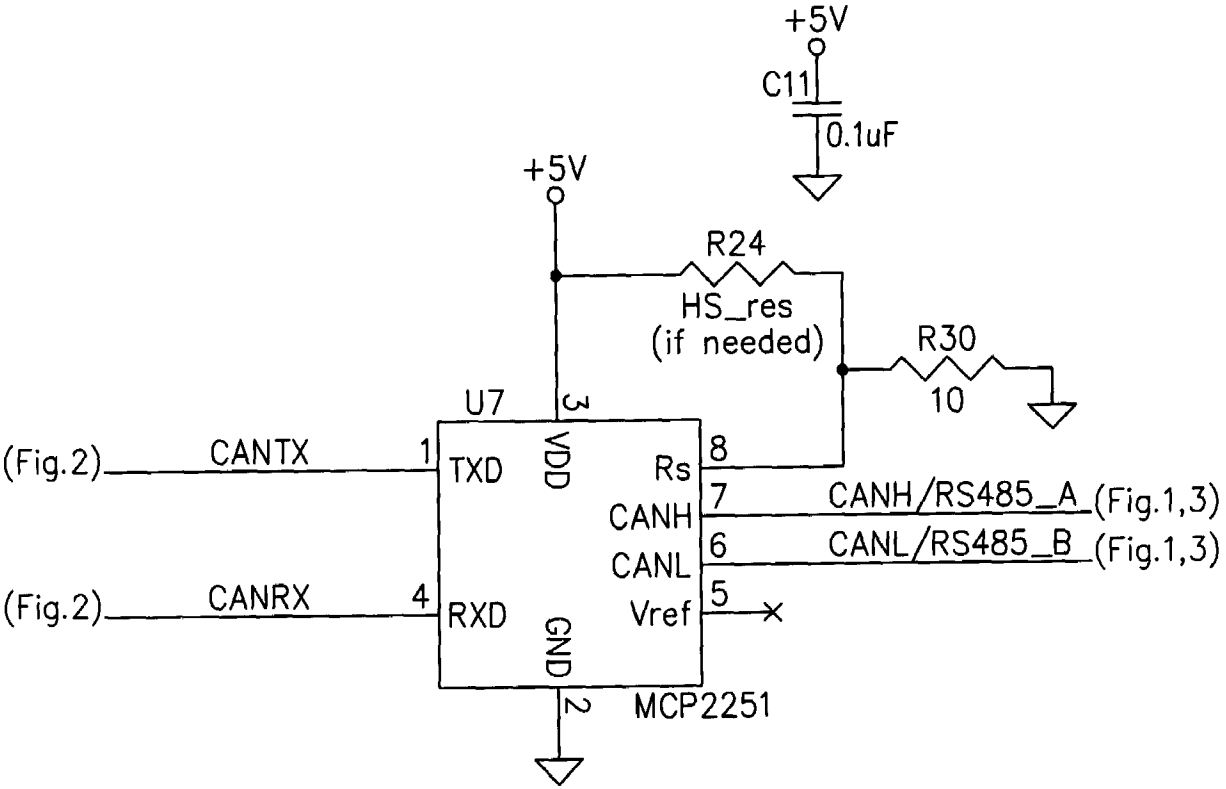

FIG. 4 shows the device U7 that converts signals between a CAN transmitter and receiver signal pair on the microcontroller U2 and a CAN communication channel. The filter capacitor C11 is provided, and the resistor R24 selects frequency dependent shaping of the pulse stream of the CAN communication and determines the rate at which communication takes place. FIGS. 1 and 2 are identified to show how the sub-circuitry of FIG. 4 is interconnected into the circuitry shown in FIG. 9.

Figure 5:
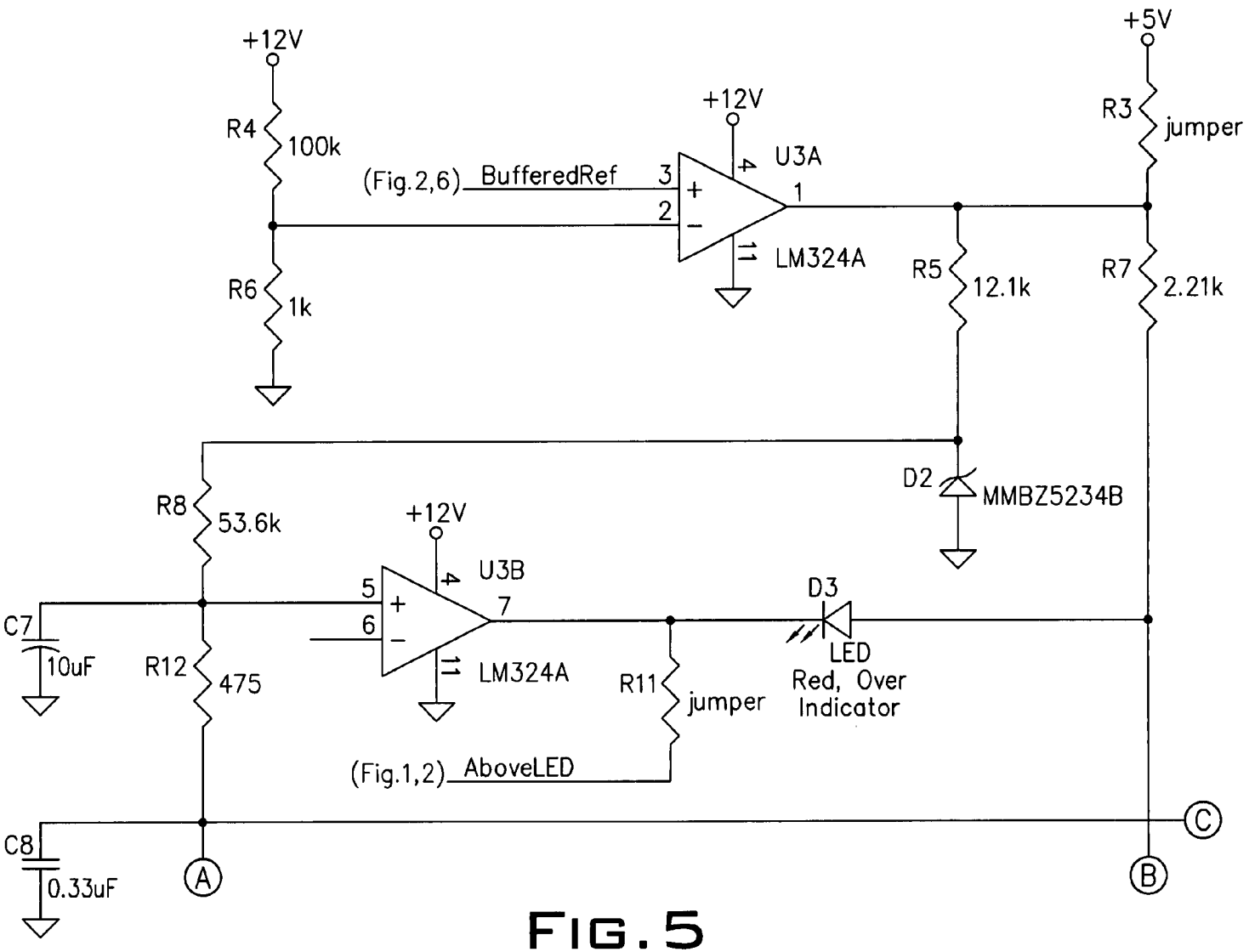

FIG. 5 interconnects into FIG. 2 as identified. U3A acts as a comparator accepting a signal BufferedRef and comparing it against a small reference voltage formed by the voltage divider R4 and R6. BufferedRef is a buffered version of the ReferenceCell signal emanating from the reference electrode 15 (FIG. 10), and also discussed with reference to FIG. 1. If BufferedRef is above the reference voltage from the reference electrode 15, the output provides a logic high voltage level to the combination R5 resistor and D2 zener diode, thus providing a relatively stable reference voltage to R8, R12 and thence following the circled "As" to FIG. 6. Resistors R8 and R12 and the other resistors on FIG. 6, R16 and R23, create a string of reference voltages that are compared to the BufferedRef signal in other sections of U3. If any of these reference voltages is greater than the BufferedRef voltage signal level, the appropriate outputs of the comparators activate the correct LED on the local LED readout on the display 27 to indicate the status of the system, i.e., over voltage, normal voltage, and under voltage conditions. These correspond to the remote LED display indications explained above with reference to FIG. 2 concerning "AboveLED," "OkLED" and "BelowLED."

When the BufferedRef signal is lower than the small reference signal, this indicates a fault in the system. The fault is most likely a failure of the reference probe electrode 15 that creates the ReferenceCell signal, and U3 indicates that this has occurred by changing its output state to a low level so that it deprives the comparator circuitry and LEDs of power. This "darkened" condition indicates to the user that a fault has occurred. When this occurs, in the manner explained above, the relay 31 is activated to cause the passive galvanic corrosion prevention system including the zincs 35 and conductor 37 to be interposed into operation.

Figure 6:
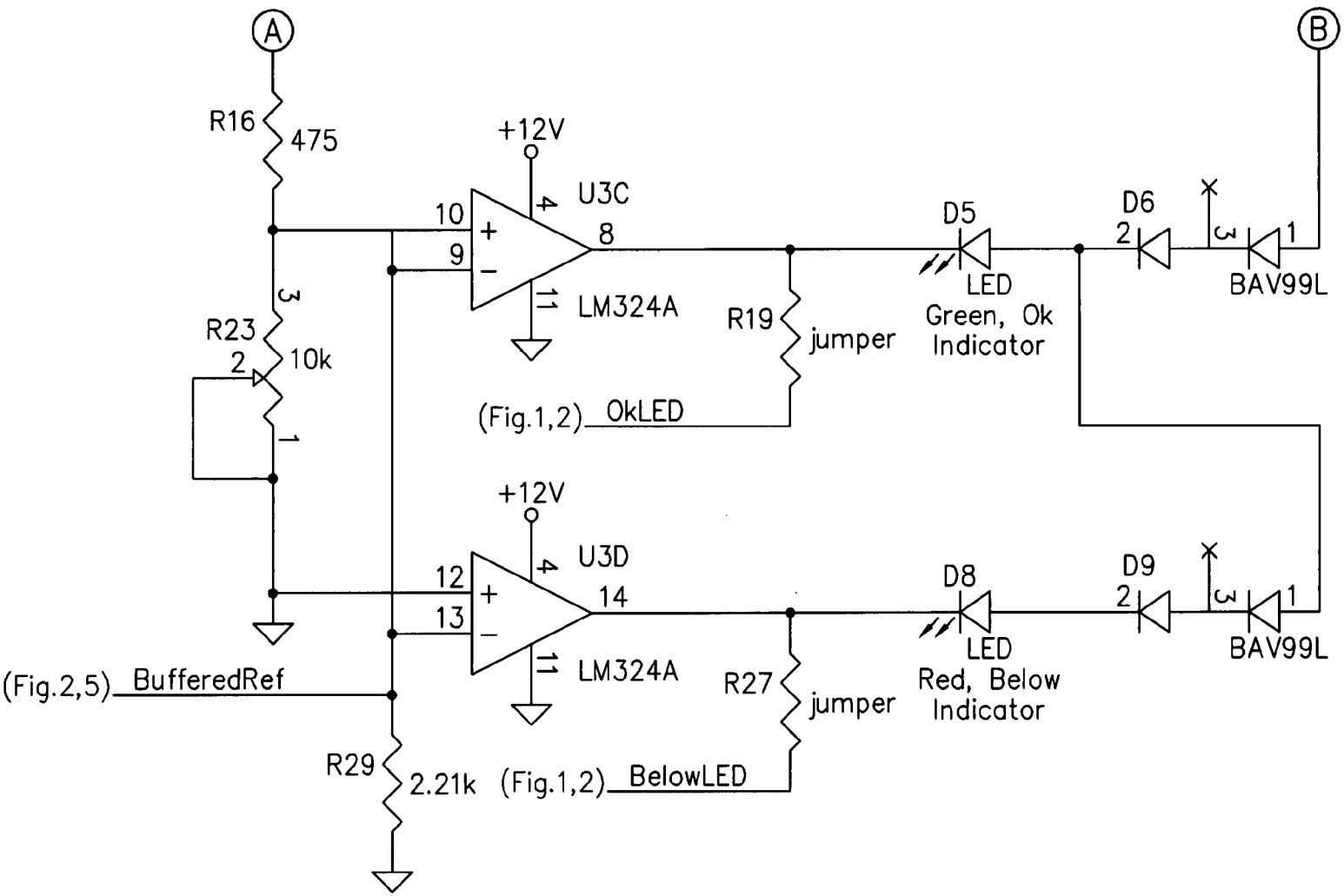

Power is provided to the status LEDs by the output of U3A (FIG. 5) when the BufferedRef is higher than a prescribed threshold. The current flows through current limiting resistor R7 (FIG. 5) to the anodes of the local LEDs. As seen by placing FIG. 5 above FIG. 6, it is seen that the signal passing through resistor R7 travels through the two circled Bs to the display LEDs that are shown in FIG. 6. R3 and R11 are optional jumper resistors that allow the corrosion control circuit board within the control box 11 to be configured to bypass the analog comparator scheme for generating the LED status lights and allowing the microcontroller to handle this function. Capacitors C7 and C8 act as filters.

With further reference to FIG. 6, in combination with FIG. 5, the voltage reference string consists of resistors R8, R12, R16 and R23 to complete the voltage reference string that is compared against the BufferedRef. R23 is, in fact, a potentiometer that allows fine-tuning of the individual comparator voltages and allows calibration of system voltages that activate the status LEDs. R29 is a stabilization resistor for the BufferedRef signal.

The extra diodes in series with the OK LED indicator and the Below LED indicator identified as D6 and D9 form voltage drops that prevent any two diodes from being lit at the same time. This provides an unambiguous reading of the current status with only one LED being lit at a time. The jumper resistors R19 and R27 allow the corrosion control circuit board within the control box 11 to configure to let the microcontroller control the status LEDs shown in FIG. 6.

As shown, the sub-circuitry of FIGS. 5 and 6 interconnects into the sub-circuitry of FIG. 2.

Figure 7:
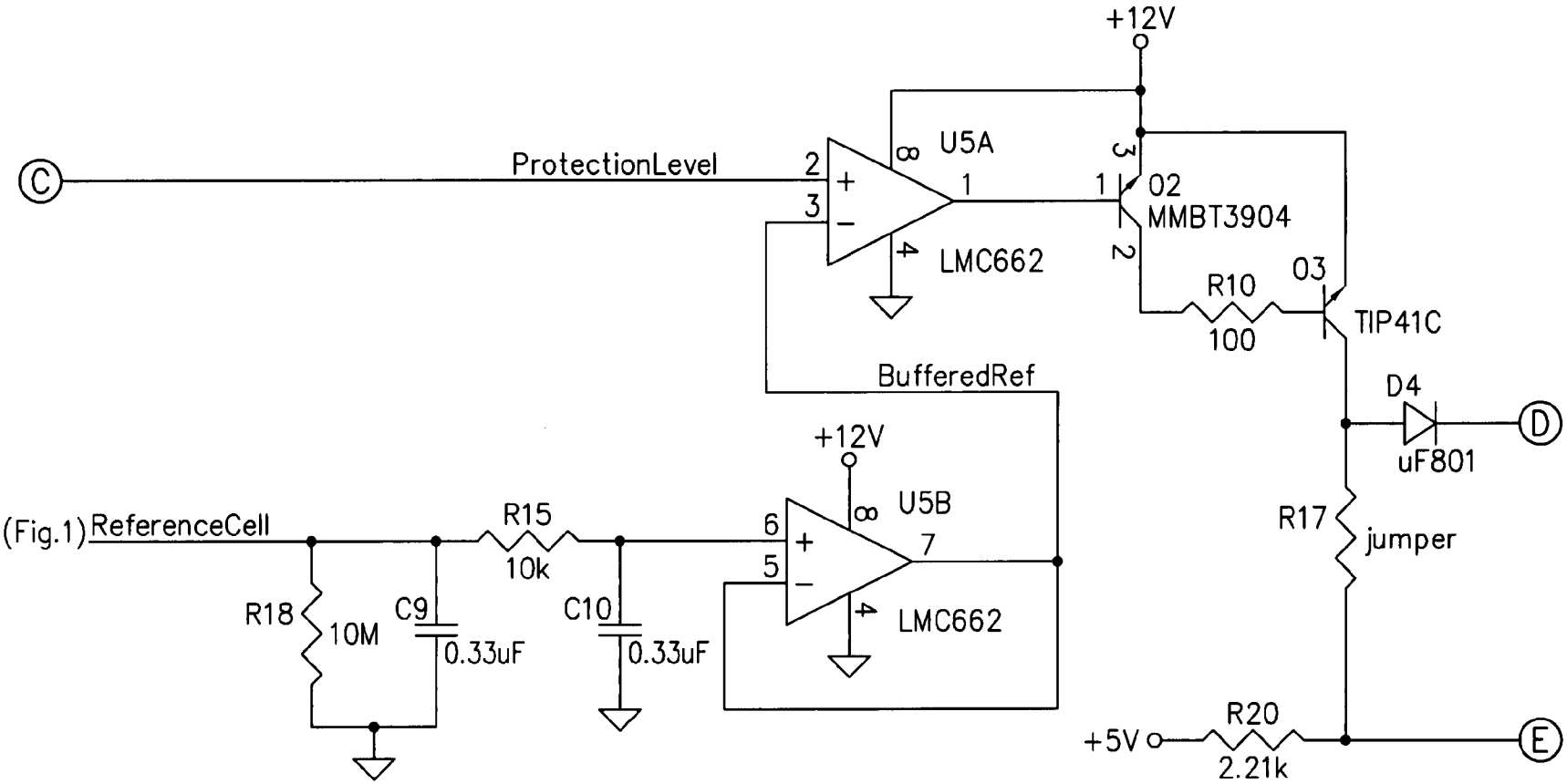

With reference to FIG. 7, it is first noted that the ReferenceCell identifier interconnects into the corresponding circuitry of FIG. 1. Furthermore, the circle C shown in the upper left-hand portion of FIG. 7 interconnects with the circle C in the lower right-hand portion of FIG. 5.

FIG. 7 shows that the ReferenceCell input described in FIG. 1 is filtered by the combination of resistors R16 and R15 and capacitors C9 and C10, and is then passed through U5B which creates a buffered version of the ReferenceCell which is aptly described hereinabove as "BufferedRef." The ProtectionLevel coming from FIG. 5 as understood from the interconnection of the two circled Cs is one of the string of reference voltages described with reference to FIG. 5. It is a voltage that represents the protection level in volts that the corrosion control circuitry attempts to maintain by continuously comparing this value against the BufferedRef and adjusting the anode voltage and current appropriately so that the potential difference between the two quantities is zero. This differencing is performed by U5A which is shown in FIG. 7. The output of U5A then drives a current amplifier made up of Q2, R10 and Q3 to force current into the anode in proportion to the amount in which the ProtectionLevel and BufferedRef are unbalanced and not equal.

Figure 8:
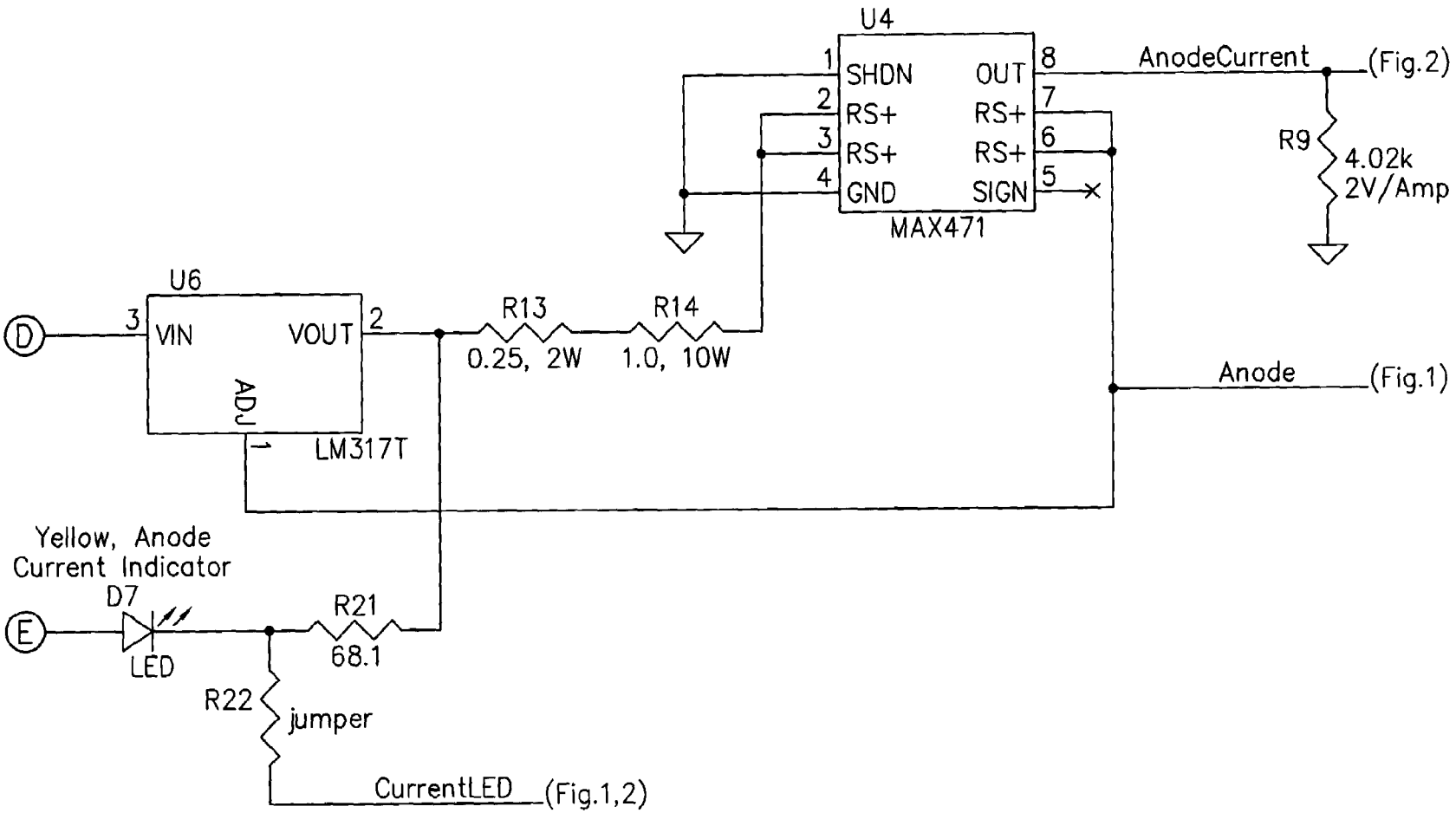

D4 is a diode with a large forward voltage drop that connects to FIG. 8 via the two circled Ds. The components in FIG. 8 combine with D4 to allow for a precise triggering of the status LED indicating current is flowing above a prescribed level. R17 is a jumper resistor connected to allow analog control of the status LED indicating that current is flowing. If the resistor R17 is omitted and the resistor R20 is loaded, the microcontroller can be made to control the activation of the status LED indicating current draw.

With reference to FIG. 8, U6 is a high current voltage regulator that serves as a known voltage drop for the purpose of activating the status LED for current draw and serves as the current limiting device. The resistors R13 and R14 serve as current limiting devices and sensing devices. They also play a role in the proper activation of the status LED indicating current draw. D7 is the status LED for current draw and R21 consists of a current limiting resistor. The resistor R22 allows a configuration of the corrosion control circuit board to permit the microcontroller to control the activation of the status LED indicating current draw. U4 is a low voltage drop high-current to low-current converter that uses the resistor R9 to generate a proportional voltage so that the microcontroller can determine the level of current draw of the system. The output of the U4 converter connects to the anode as shown with reference to FIG. 2.

With FIGS. 1–8 having been described in the context of their assembly together shown in FIG. 9, and in the context of the schematic representation of the circuitry of the present invention shown in FIG. 10, the operation of the present invention should now be well understood.

As explained above, the main objective of the present invention identified by reference numeral 10 is to provide a corrosion-free electrical state in the water surrounding a marine vessel by comparing a water contacted reference cell voltage level (15) with a settable protection level voltage level (17) in a feedback loop that continuously adjusts the voltage and current to a water contacted anode (13), thereby offsetting corrosion-causing potential differences. If power is ever removed from the corrosion control circuit board within the control box 11, a fail-safe innovation is provided by removing power from the activation coil of a normally closed relay 31, thereby automatically turning the relay 31 off, closing the circuit between the contacts, and connecting the conventional sacrificial anode 35 to the grounding system of the marine vessel.

The microcontroller U2 may also have an additional fail-safe feature that detects if the reference cell voltage has failed and if this occurs, removes power from the activation coil of the relay 31 by shutting the current off to the coil. This allows fail-safe operation of the redundant passive galvanic corrosion control system even if the voltage of the battery 29 is still good and the circuit is still under power.

In a further aspect, the status LEDs may be supplemented by a remote set of LEDs that can be driven remotely as desired.

Through use of the present invention, fail-safe protection of submerged metal parts on a marine vessel is achieved. The active aspect of the present invention is a quite effective means for precluding galvanic corrosion of those submerged metallic components. Should that system fail, for any reason, the usual passive protection system using zincs is immediately put into play.

As such, an invention has been disclosed in terms of a preferred embodiment thereof which fulfills each and every one of the objects of the invention as set forth hereinabove, and provides a new and useful marine vessel corrosion control system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. In a marine vessel adapted to float on a body of water and having at least one metal part submerged within a body of water when said marine vessel is floating therein, the improvement comprising a corrosion control system comprising:

a) at least one sacrificial anode connected to (1) said at least one metal part, and (2) to a ground;

b) an electrical circuit including:

i) a source of electrical current;

ii) a further anode immersed in said body of water and connected to said source;

iii) controller means for controlling application of electrical current from said source to said further anode, said controller means comprising a microcontroller;

iv) switch means for controlling electrical connection between said sacrificial anode and ground, and an actuator for said switch means operated by said controller means;

v) means for sensing a malfunction in operation of said controller means;

c) whereby when said malfunction sensing means senses a malfunction in operation of said controller means, said switch means is caused to close connection between said sacrificial anode and ground.

2. The system of claim 1, wherein said sacrificial anode comprises a piece of zinc.

3. The system of claim 1, wherein said at least one metal part comprises a plurality of metal parts, each of which has a piece of zinc attached thereto.

4. The system of claim 1, wherein said source of electrical current comprises a battery.

5. The system of claim 1, wherein said controller means comprises a microcontroller.

6. The system of claim 1, wherein said switch means comprises a relay.

7. The system of claim 1, wherein said relay is normally closed.

8. The system of claim 7, wherein said relay is electrically connected to said controller means, whereby when said controller means is activated, an actuating signal is sent to said relay to open said relay and disconnect said sacrificial anode from said ground.

9. The system of claim 8, whereby when said controller means is de-activated, said actuating signal is terminated causing said relay to close and connect said sacrificial anode to said ground, termination of said actuation signal comprising said malfunction sensing means.

10. The system of claim 1, said sensor means comprising first sensor means, said system further including second sensor means immersed in said body of water and connected to said controller means for providing said controller means a reference voltage, said controller means comparing said reference voltage with a preset voltage standard and, responsive to said comparing, applying a prescribed voltage to said further anode.

11. The system of claim 10, wherein said switch means comprises a normally closed relay.

12. The system of claim 11, wherein said relay is electrically connected to said controller means, whereby when said controller means is activated, an actuating signal is sent to said relay to open said relay and disconnect said sacrificial anode from said ground.

13. The system of claim 12, whereby when said controller means is deactivated, said actuating signal is terminated causing said relay to close and connect said sacrificial anode to said ground.

14. In a marine vessel adapted to float on a body of water and having a plurality of metal parts submerged within a body of water when said marine vessel is floating therein, the improvement comprising a corrosion control system comprising:

a) at least one sacrificial anode connected to (1) each metal part, and (2) to a ground;

b) an electrical circuit including:

i) a source of electrical current comprising a battery;

ii) a further anode immersed in said body of water and connected to said source;

iii) a microcontroller controlling application of electrical current from said source to said further anode;

iv) a normally closed relay controlling electrical connection between said sacrificial anode and ground, and an actuator for said relay operated by said microcontroller;

v) means for sensing a malfunction in operation of said microcontroller; and vi) a means for communicating with a peripheral device;

c) whereby when said malfunction sensing means senses a malfunction in operation of said micro controller, said relay is caused to close connection between said sacrificial anode and ground.

15. The system of claim 14, wherein the means for communicating is an RS485 channel.

16. The system of claim 14, wherein the means for communicating is a CAN channel.

17. The system of claim 14, further comprising three indicators for indicating over voltage, normal operation and under voltage.

18. The system of claim 14, wherein said peripheral device is a remote display.

* * * * *